US005370448A

United States Patent [19]

Sterwerf, Jr.

[11] Patent Number: 5,370,448

[45] Date of Patent: Dec. 6, 1994

[54] WEDGING ARRANGEMENT FOR ATTACHING A BIT HOLDER TO THE BASE MEMBER OF A MINING ROAD WORKING, OR EARTH MOVING MACHINE

[75] Inventor: Lester J. Sterwerf, Jr., Harrison, Ohio

[73] Assignee: Cincinnati Mine Machinery Company, Cincinnati, Ohio

[21] Appl. No.: 62,392

[22] Filed: May 17, 1993

[51] Int. Cl.[5] ..... E21B 12/00

[52] U.S. Cl. ..... 299/91; 175/413

[58] Field of Search ..... 299/86, 91, 92; 175/413

[56] References Cited

U.S. PATENT DOCUMENTS

| | | | |
|---|---|---|---|
| 990,846 | 5/1911 | Crandall | 299/91 X |
| 990,847 | 5/1911 | Crandall | 299/91 X |
| 993,553 | 5/1911 | Rosenbeck | 407/101 X |
| 1,908,161 | 5/1933 | Meutsch | 299/91 |
| 2,612,361 | 9/1952 | Hagenbook | 299/91 X |
| 3,049,358 | 8/1962 | Polos . | |
| 3,268,260 | 8/1966 | Snipe | 299/91 |
| 3,429,617 | 2/1969 | Lauber | 299/93 |
| 3,498,677 | 3/1970 | Morrow | 299/92 |
| 3,499,685 | 3/1970 | Kniff | 299/86 |
| 3,537,539 | 11/1970 | Adcock | 175/413 |
| 3,659,654 | 5/1972 | Davies et al. . | |
| 4,337,980 | 7/1982 | Krekeler | 299/91 |
| 5,088,797 | 2/1992 | O'Neill | 175/413 X |

FOREIGN PATENT DOCUMENTS

| | | |
|---|---|---|
| 743234 | 1/1956 | United Kingdom . |
| 1209374 | 10/1970 | United Kingdom . |
| 1218308 | 1/1971 | United Kingdom . |
| 1486212 | 9/1977 | United Kingdom . |

*Primary Examiner*—David J. Bagnell
*Attorney, Agent, or Firm*—Frost & Jacobs

[57] ABSTRACT

A base member and bit holder assembly for replaceably mounting a bit on a mining machine, road working machine or earth moving machine. The bit is of the type having a shank terminating in at least one working end. The bit holder has a shank receiving perforation therein to receive the shank of the bit. A bit retainer releasably retains the bit shank in the bit holder shank receiving perforation. Cooperating abutment surfaces on the bit holder and bit determine the depth to which the bit shank extends into the shank receiving perforation of the bit holder. The bit holder has a tapered shank portion, and the base member has a correspondingly tapered cavity extending therethrough. The angularity of the tapers of the bit holder shank and base member cavity are the same, falling within the range of from about 6° to about 12° and are such that once the bit holder shank has been set in the base member cavity it will remain there until removed by an appropriate tool. The rearmost end of the bit holder extends through the base member and is provided with a split metal safety ring.

19 Claims, 2 Drawing Sheets

WEDGING ARRANGEMENT FOR ATTACHING A BIT HOLDER TO THE BASE MEMBER OF A MINING ROAD WORKING, OR EARTH MOVING MACHINE

TECHNICAL FIELD

The invention relates to a base member and bit holder assembly for mounting a bit on a mining, road working or earth moving machine, and more particularly to such an assembly wherein the bit holder has a tapered shank receivable in a corresponding tapered cavity in the base member and is fixedly held therein by a wedging action, while being removable therefrom by an appropriate prying action.

BACKGROUND ART

In the field of mining machines such as continuous miners and the like, road working machines such as road planers and the like, and earth moving machines such as mechanized shovels and the like, it is common practice to provide the machine with a driven element having a plurality of bits mounted thereon. The term "bit" should be considered broadly enough to cover mining machine cutter bits and road working and earth moving machine digger teeth. It is common practice on these machine to provide each bit with a bit holder and to provide each bit holder with a base member by which it is attached to the driven element of the machine. In some instances, the base member may constitute an integral, one-piece part of the driven element of the machine.

As will be readily understood by one skilled in the art, bits are subject to great wear and have a relatively short working life. As a consequence, the bit must be easily replaceable with respect to the bit holder. Similarly, the bit holder is also subject to wear, but generally not as severe wear as is encountered by the cutter bit. Nevertheless, it is important that the bit holder be readily replaceable with respect to its base member. It is to the replaceable mounting of a bit holder in its base member that this invention is directed. While not intended to be so limited, for purposes of an exemplary showing, the present invention will be described in its application to bit ;holder and base member assemblies of mining machines. It will be apparent to one skilled in the art that the teachings of the present invention are directly applicable to bit holder and base member assemblies of road working and earth moving machines, as well.

There are many types of mining machines, all-of which are characterized by the presence of one or more primary drive members to which there is affixed at least one, and generally a plurality of base members, adapted to receive bit holders and cutter bits.

The driven member, driven by appropriate prime mover means, may take a number of forms such as a chain, a rotating wheel, a rotating arm, or a rotating drum. Mining machines, themselves, are of various types including undercutting machines, continuous mining machines, and long wall mining machines.

Recognizing the necessity for bit holder and base member assemblies wherein the bit holder is readily removable from the base member, prior art workers devised many arrangements. For example, a number of "pin-on" arrangements have been developed, and the arrangement taught in U.S. Patents Re 28,310 and 4,163,581 are exemplary. Similarly, a number of "wedge-on" arrangements have been devised, of which the teachings of U.S. Pat. Nos. 4,057,294 and 4,275,929 are exemplary. One of the best known and most heavily used systems for removably mounting a bit holder in a base member is set forth in U.S. Pat. No. 4,337,980. The teachings of this patent are incorporated herein by reference.

Briefly, U.S. Pat. No. 4,337,980 sets forth a novel wedge arrangement for affixing a tool mounting means onto a base member in such manner that substantially no relative movement occurs between the mounting means and the base member, thus vastly improving the working lives of both. According to the wedge arrangement of this patent, the bit holder is provided with a tapered portion and the base member is provided with a tapered cavity to receive the tapered portion of the bit holder. That part of the base member which defines the cavity completely surrounds that part of the tapered portion of the bit holder seated therein for at least a portion of the length of the tapers, so that the wedge arrangement is 360° in scope. The resultant cutting forces encountered during operation of the mining machine serve to urge the tapered portion of the bit holder into its seated position within the tapered cavity of its base member. Contact between the tapered portion of the bit holder and the base member cavity is such that there is no rotation, wobble or other relative movement between the two when the tapered portion of bit holder is properly seated in the tapered cavity of the base member. This contact may also be 360° in scope, although this is not the case in all embodiments of this reference:.

In all the embodiments illustrated and described in U.S. Pat. No. 4,337,980, retaining means are taught which retain the tapered portion of the bit holder in its seated position within the tapered cavity of the base member, and urge the bit holder tapered portion into full seated position within the base member while simultaneously precluding rotation of the bit holder tapered portion within the base member tapered cavity. The reference teaches a number of different types of retaining means to retain the bit holder in the base member and to urge the bit holder to its fully seated position. These retaining means include bolts, wedging-type C-shaped retainers, wedges and deformable resilient means. Perhaps the most common means for retaining the bit holder within the base member, taught in U.S. Pat. No. 4,337,980, is the provision of a cylindrical portion at the end of the tapered portion of the bit holder. The tapered cavity of the base member extends through the base member and the cylindrical portion of the bit holder also extends through the base member. The cylindrical portion is threaded and is adapted to receive a nut which tightens against a rearward surface of the base member.

The present invention is intended to constitute an improvement upon the teachings of U.S. Pat. No. 4,337,980. In the field, it has been found that manipulation of the retaining means for the bit holder with respect to the base member is sometimes difficult and time consuming. In U.S. Pat. No. 4,337,980 it is hinted that, under some circumstances, the wedging action alone may be sufficient to prevent rotation of the tapered portion of the bit holder within the tapered cavity of the base member and removal of the tapered portion of the bit holder from the tapered cavity of the base member. The reference does not teach or suggest, however, under what circumstances this might be so and just how this might be accomplished. All of the embodiments illustrated, described and claimed in U.S. Pat. No. 4,337,980 are provided with retaining means to urge the bit holder to its fully seated position within the base member and to maintain it there.

The present invention is based upon the discovery that if the tapers of the bit holder portion and the corresponding tapered cavity of the base member have a common angularity up to about 12°, and preferably in the range of from about 6° to about 12°, a retaining means for urging and maintaining the tapered portion of the bit holder in the tapered cavity of the base member is not required. The bit holder will remain fully seated and non-rotatable within the base member cavity during operation of the mining machine under substantially all conditions of cutting and over a wide range of materials being cut. The bit holder is preferably provided with a safety ring, as will be described hereinafter. It has further been found that the preferred angularity of the taper of the tapered portion of the bit holder and the tapered cavity of the base member will vary within the above-stated range, depending upon the type of mining machine employed. When replacement of the bit holder is required, it can be removed from the base member by an appropriate prying action.

It is taught in U.S. Pat. Nos. 4,337,980 that there are a number of types of mining machine cutter bits including those which rotate within the shank receiving perforation of the bit holder, and those which do not. Prior art workers have used many means to secure cutter bit shanks in the shank receiving perforations of bit holders. The retaining means include set screws and other mechanical latching or locking devices and resilient retaining means enabling a "knock-in", "pry-out" engagement between the cutter bit and the bit holder. These include retainers developed specifically for non-rotating bits and others developed specifically for rotating bits. The nature of the cutter bit and whether or not it is a rotatable cutter bit do not constitute limitations of the present invention. In most instances, the cutter bit will comprise an elongated shank, at least a portion of which is rotatively or non-rotatively receivable within the shank receiving perforation of the bit holder. The cutter bit shank will terminate, at at least one end thereof, in a cutting head bearing a cutting tip, or simply in a cutting tip. In some instances, the cutter bits are double ended, so that when one cutting end becomes badly worn, it can be replaced by the other cutting end.

DISCLOSURE OF THE INVENTION

According to the invention there is provided a base member and bit holder assembly for replaceably mounting a cutter bit on the driven portion of a mining machine, road working machine or earth moving machine. The bit is of the type having a shank terminating in at least one working end. The bit holder has a shank receiving perforation therein to receive the shank of the bit. A bit retainer releasably retains the bit shank in the bit holder shank receiving perforation, and cooperating abutment surfaces on the bit holder and bit determine the depth to which the bit shank extends into the shank receiving perforation of the bit holder.

The bit holder has a tapered shank portion. The base member has a correspondingly tapered cavity extending therethrough. The angularity of the taper of the bit holder shank and the angularity of the taper of the base member cavity are the same and are up to 12°. Preferably, the angularities fall within the range of from about 6° to about 12°. The taper of the bit holder shank and base member cavity is such that, once the bit holder shank has been set in the base member cavity by several axial blows with an appropriate tool, the bit holder shank will remain in the base member cavity with no relative axial or rotational movement therebetween. The rearmost end of the bit holder extends through the base member and is provided with an annular groove which is spaced from the adjacent rearward surface of the base member. A split metal safety ring is mounted in the annular groove. When it is desired to remove the bit holder from the base member, the split metal ring is disengaged from the annular groove in the bit holder and the bit holder is removed from the base member by a prying action using an appropriate prying tool.

DETAILED DESCRIPTION OF THE INVENTION

Figure 1:
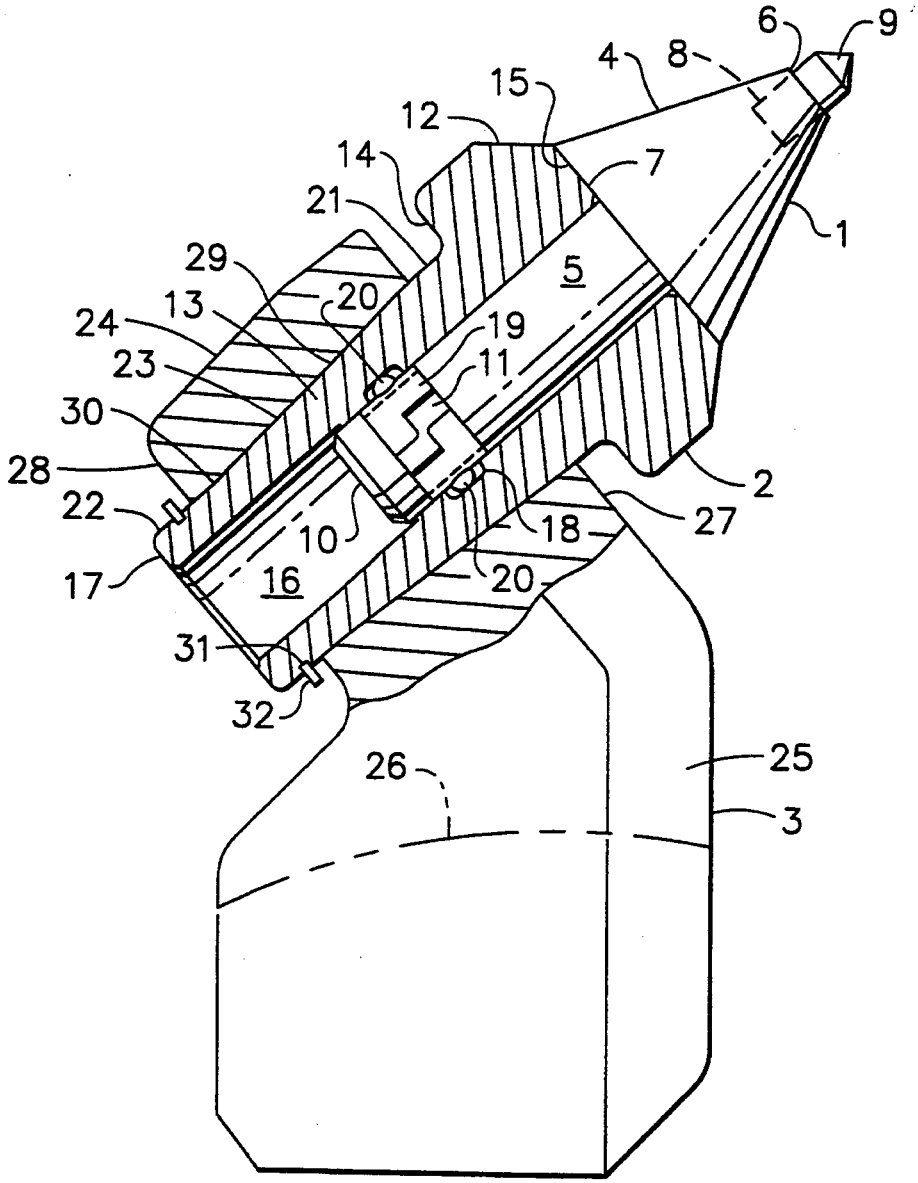
FIG. 1 is a side elevational view, partly in cross section, illustrating a cutter bit mounted in an exemplary bit holder and base member of the present invention.
Figure 2:
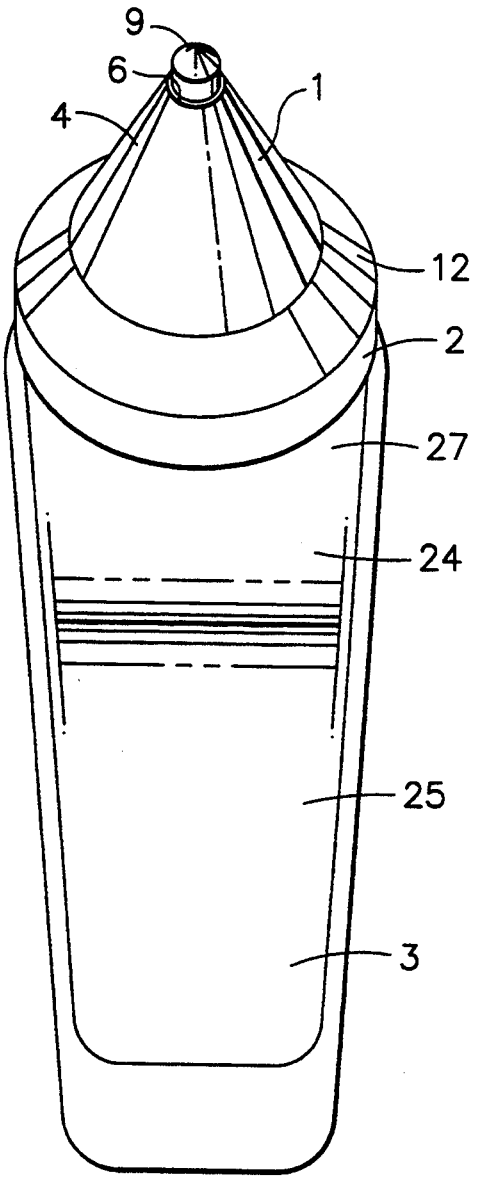
FIG. 2 is an elevational view of the structure of FIG. 1 as viewed from the right of FIG. 1.
Figure 3:
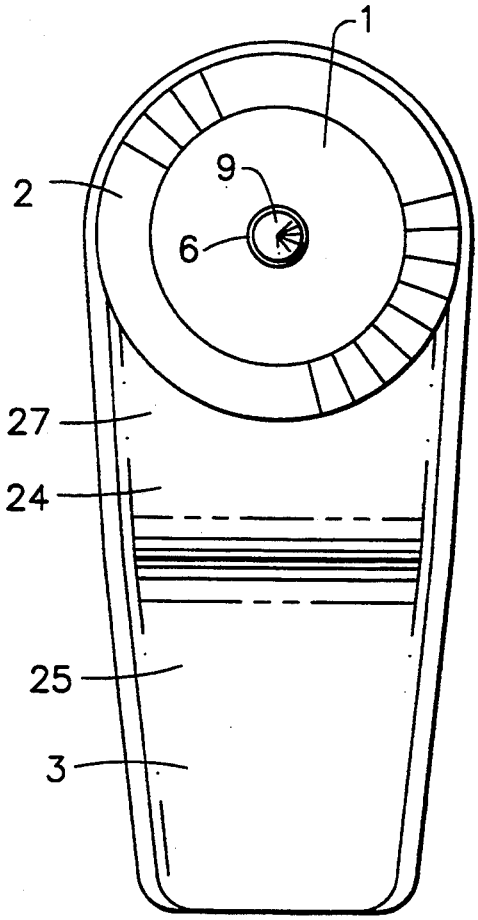
FIG. 3 is an elevational view of the structure of FIG. 1 as viewed from the right of that Figure and along the axis of the cutter bit.

Reference is made to FIGS. 1–3 wherein an exemplary application of the teachings of the present invention is illustrated and wherein like parts have been given like index numerals. In these Figures, a mining machine cutter bit 1 is shown mounted in an assembly of a bit holder 2 and a base member 3.

In the above-noted U.S. Pat. No. 4,337,980, the wedging arrangement set forth therein was described and illustrated as being applicable to many types of rotatable and non-rotatable cutter bits. The same is, of course, true of the wedging arrangement of the present invention. Perhaps the most commonly used bits today are the so called "square shoulder bits" and "plumb-bob bits". For this reason, and for purposes of an exemplary showing, the bit 1 is illustrated as being of the square shoulder type. The bit 1 comprises an elongated member having a head portion 4 and a shank portion 5. The head portion 4 flares or tapers downwardly and outwardly from its forward end 6 to its rearward end 7. The forward and rearward ends 6 and! 7 of the head 4 each lies in a plane perpendicular to the long axis of the cutter bit 1. As a consequence, both bit head ends 6 and 7 constitute flat, annular surfaces. The forward end 6 has an axial bore 8 formed therein. The bore 8 is adapted to receive a hard cutting tip 9, such as a carbide tip, which is welded or otherwise appropriately fixed in bore 8.

The bit shank 5 is cylindrical and extends axially and rearwardly from the rear surface 7 of bit head 4. The shank 5 terminates in a rearward end 10. Near the rearward end 10, the shank 5 is provided with an annular groove 11, the purpose of which will be apparent hereinafter.

The bit holder 2 comprises a forward head portion 12 and a rearwardly extending shank portion 13. The head portion 12 is of greater diameter than the shank portion 13, forming an annular shoulder 14 at their juncture.

The forward end of the head portion 12 of bit holder 2 terminates in a surface 15 which lies in a plane perpendicular to the long axis of the bit holder 2. The bit holder 2 has an axial bore 16 which extends through the forward surface 15 of the bit holder and through the rearward end surface 17 thereof. The rearward end surface 17 of bit holder 2 is an annular surface lying in a plane perpendicular to the long axis of the bit holder. As will be described more fully hereinafter, the axial bore 16 is adapted to receive the shank 5 of cutter bit 1, and therefore constitutes a shank receiving perforation.

With certain types of non-rotatable bits, the bit shank is non-circular in cross section. In such an instance, the shank receiving perforation of the bit holder will have a correspondingly shaped cross section. A square shouldered bit and a plumb-bob bit are intended to have their shanks rotatable within the bit holder shank receiving perforation, and therefore the cutter bit shank and the bit holder shank receiving perforation are of circular cross section. Such is the case in the embodiment illustrated. The shank receiving perforation 16 will be of a diameter just slightly greater than that of the bit shank 5, enabling the bit shank 5 to rotate with the shank receiving perforation 13 without undue wobble. The forwardmost surface 15 of the bit holder and the rearwardmost surface 7 of the cutter bit head 4 constitute cooperating abutment surfaces. The abutment of these surfaces determines the depth to which the shank 5 extends into the shank receiving perforation 16.

It will be noted that the shank receiving perforation 16 has an annular groove 18 formed therein. The annular groove 18 lies opposite the annular cutter bit shank groove 11 when the cutter bit 1 is fully seated in the bit holder 2.

A conventional and well-known retaining means 19 is shown mounted in the annular groove 11 of cutter bit shank 5. The retaining means 19 comprises a resilient split metal ring provided with rounded protrusions 20 on its outer surface. The protrusions 20 extend into the annular groove 18 of the bit holder. As a consequence, the retaining means is captively mounted on the cutter bit shank 5 and engages the annular groove 18 of the bit holder 2, thereby maintaining the cutter bit shank 5 within shank receiving perforation 16, without interfering with rotational movement of the cutter bit shank 5 within the shank receiving perforation 16.

The bit 1, provided with retainer 19, can be mounted in the bit holder 2 by simply locating the free end 10 of the bit shank 5 in the shank receiving perforation 16 of the bit holder 2 and directing a series of axial blows to the bit head 4 with an appropriate tool. The rounded protrusions 20 of the retainer 19 will coact with the shank receiving perforation 16 to cause the split metal retainer 19 to contract circumferentially into the bit shank groove 11 enabling the rounded extensions 20 to pass through the shank receiving perforation 16. When the extensions 20 reach the shank receiving perforation groove 18, they will enter the groove 18, enabling the retainer 19 to expand circumferentially to its normal diameter. The retainer 19 and its extensions 20 act in exactly the same way when the cutter bit 1 is pulled forwardly out of the shank receiving perforation 16 for purposes of replacement. Removal of the cutter bit 1 is accomplished by means of an appropriate prying tool, (not shown). It will be noted from FIG. 1 that the extensions 20 of retainer 19 have considerable clearance in notch 18, so that some axial movement of the bit 1 is possible. This being the case, a bifurcated wedgeshaped tool can be inserted between the bit surface 7 and the bit holder surface 15 and the bit 1 can be removed from the bit holder 2 by an appropriate prying action. In some instances, the head portion 4 of the bit 1 is provided with an annular groove at or near its rearward surface 7, for the receipt of a bifurcated prying tool.

As is well known, a plumb-bob bit is similar to the square shoulder bit 1 of FIG. 1, differing only in that the bit abutment surface 7 and the bit holder abutment surface 15 are correspondingly tapered, sloping inwardly and rearwardly toward the bit shank 5.

The shank portion 13 of the bit holder 2 has a first cylindrical portion 21 adjacent the bit holder shoulder 14. The shank 13 has a second cylindrical portion 22 adjacent the bit holder rearward end 17. Finally, the shank has an intermediate tapered portion 23, which constitutes the majority of the length of the shank. It would be within the scope of the invention to have the shank portion 13 tapered throughout its length.

The base member 3 comprises a unitary body having an upper portion 24 and a lower portion 25. The lower body portion 25 of the base member 3 may have any appropriate configuration enabling it to be welded or otherwise appropriately affixed to the driven member of the mining machine. Where the driven member of the mining machine constitutes a rotating drum, the lower body portion 25 of the base member 3 :may terminate in an arcuate surface indicated by a broken line at 26, matching the exterior cylindrical surface of the drum, enabling the base member 3 to be welded thereto.

The upper body portion 24 of the base member 3 may be angularly related to the lower body portion 25, as shown in the Figures, so that when the bit holder 2 and cutter bit 1 are mounted therein, the cutter bit will have the proper angular relationship to the material being cut.

The upper body portion 24 of the base member 3 has a forward face 27 and a rearward face 28. Although not required, the forward and rearward faces 27 and 28 are illustrated as being substantially planar and in parallel spaced relationship with respect to each other. The upper base member body portion 24 has a tapered cavity 29 which extends therethrough from forward face 27 through rearward face 28. The cavity 29 may be tapered throughout its length. In the embodiment illustrated, the cavity 29 is tapered throughout the majority of its length, having a cylindrical portion 30 near the rearward face 28 of the base member upper body portion 24.

The shank portion 13 of bit holder 2 and the cavity 29 of base member 3 may have any appropriate cross sectional configuration so long as they correspond. A circular cross section is preferred because it is easier to produce. The taper of the base member cavity 29 and the taper of the portion 23 of the shank 13 of the bit holder 2 must have the same angularity. It has been found that when this angularity is up to about 12°, and preferably falls within the range of from about 6° to about 12°, the bit holder shank portion 13, once fully seated within the base member cavity 29, will remain in the base member cavity 29 with no relative axial or rotational movement therebetween. This is true under substantially all conditions of cutting and over a wide range of materials being cut. It has been found that if the corresponding tapers of the base member cavity 29 and the bit holder shank portion 13 are less than about 6°, removal of the bit holder shank portion 13 from the base member cavity 29 becomes extremely difficult. On the other hand, if the angularity of the corresponding tapers of the bit holder shank portion 13 and the base member cavity 29 is greater than about 12°, the bit holder shank portion 13 will not remain in the base member cavity 29 without the use of some sort of retaining device such as those taught in the above-noted U.S. Pat. No. 4,337,980.

It has further been found that within the above stated range of from about 6° to about 12°, there may be a preferred angularity which will vary depending upon the type of mining machine being used. For example, for most continuous mining machines, the preferred angularity of the corresponding tapers of the bit holder shank portion 13 and the base member cavity 29 is about 8°. For a long wall mining machine, the preferred taper angularity is about 10°. This is true because the long wall mining machine, by virtue of its construction and operation, imparts a greater force on the bit holder tending to urge the bit holder shank portion to its fully seated position within the base member cavity during cutting operations, than does a continuous miner. As a consequence, it has been found that a taper angularity of about 10° is adequate to assure that the bit holder shank portion 13 will remain fully seated in the base member cavity 29 without any relative axial or rotational movement therebetween, and the bit holder shank portion 13 will be easier to remove from the base member cavity for purposes of replacement, than if the angularity was about 8°.

It will be noted from FIG. 1 that there are no corresponding abutment surfaces between ate bit holder 2 and the base member 3, such as the abutment surfaces 7 and 15 between the bit 1 and the bit holder 2. As a consequence, there is no obstruction to prevent the desired 360° wedging action between the bit holder shank 13 and the base member cavity 29. The wedging arrangement of the present invention has all of the advantages of the wedging arrangement taught in the above-noted U.S. Pat. No. 4,337,980, but does not require the additional steps and difficulties associated with applying and removing a bolt, nut, or other type of retaining means for maintaining the bit holder shank portion 13 in the base member cavity 29.

In the preferred embodiment, as is clearly shown in FIG. 1, the rearwardmost cylindrical end portion 22 of the bit holder shank portion 13 is provided with an annular groove 31. The groove is adapted to receive a split metal ring 32 which acts as a safety ring. It will be noted that the groove 31 and the ring 32 are spaced from the rear surface 28 of the base member upper body portion 24. The sole purpose of safety ring 32 is to prevent unwanted removal of the bit holder shank 13 from the base member cavity 29 during a cutting operation, in the unlikely circumstance that some sort of removal force would be applied to the bit holder during a cutting operation. It will be understood by one skilled in the art that other safety retaining means, such as a transverse retaining pin, could be used.

Installation of the bit holder 2 in the base member 3 may be accomplished in the following manner. The bit holder shank portion 13 is inserted in the base member cavity 29. A series of axial blows is applied to the forward surface 15 of the bit holder to "set" the wedging action of the present invention between the bit holder shank portion 13 and the base member cavity 29. Thereafter, the safety ring 32 is mounted in groove 31. Cutter bits can be mounted and removed from the bit holder 2 in the manner described above.

When it becomes necessary to replace the bit holder 2, this can be accomplished in the following manner. First of all, the safety ring 32 is removed from the groove 31. Thereafter, a wedge-shaped bifurcated drift may be inserted between the bit holder shoulder 14 and the forward face 27 of base member 3. A few blows to such a drift would overcome the wedging action of the present invention between the bit holder shank portion 13 and the base member cavity 29. In similar fashion, a bifurcated prying tool can be inserted between the bit holder shoulder 14 and the base member forward surface 27 and used to overcome the wedging action of the present invention. Once the wedging action between the bit holder shank 13 and the base member cavity 29 has been overcome, the bit holder shank 13 can readily be removed from the base member cavity 29. The bit holder 2 could be removed from the base member cavity 29 by applying an external axial force on surface 17 of the bit holder by means of a hydraulically actuated tool or other appropriate device.

It will be apparent, especially from FIG. 1, that in the embodiment illustrated, the majority of the bit holder shank portion 13 is located within the base member cavity 29. Similarly, the shank 5 of the cutter bit 1 extends fully within the shank receiving perforation 16 of bit holder 2 and a portion, at least, of the cutter bit shank 5 lies within the base member cavity 29. This provides a very compact and strong assembly.

Modifications may be made in the invention without departing from the spirit of it.

What is claimed:

1. A base member and bit holder assembly for mounting a bit, of the type having a shank terminating in at least one working end, to a driven portion of a mining, road working, or earth moving machine, said bit holder having a tapered shank, and a bit shank receiving perforation adapted to receive a shank of a bit with the at least one working end thereof extending beyond said bit holder, said base member having an upstanding body with forward and rearward faces, said base member having a tapered cavity extending therethrough from said forward face through said rearward face thereof, said tapers of said bit holder shank and base member cavity corresponding and having the same angularity of up to about 12°, whereby, once said bit holder shank is set in said base member cavity by axial blows to said bit holder from an appropriate tool, it will remain therein without relative rotational :and axial movement between said bit holder shank and said base member cavity until said bit holder is removed from said base member by an appropriate prying tool.

2. The base member and bit holder assembly claimed in claim 1 wherein said bit holder shank has a rearward end portion, said bit holder shank rearward end portion extending beyond said rearward face of said base member when said bit holder is set in said base member, said rearward end portion having an annular groove formed therein spaced rearwardly of said base member rear face, a split metal safety ring mounted in said groove.

3. The base member and bit holder assembly claimed in claim 1 wherein said bit holder shank has a forward end, and an enlarged head at said forward end, an annular rearwardly facing shoulder on said bit holder at the juncture of said head and tapered shank thereof, said annular shoulder being substantially parallel to said forward face of said base member and spaced therefrom when said bit holder is set in said base member, whereby a prying tool can be inserted therebetween for removal of said bit holder from said base member.

4. The base member and bit holder claimed in claim 1 wherein said tapers have an angularity falling within the range of from about 6° to about 12°.

5. The base member and bit holder assembly claimed in claim 1 wherein said tapers have an angularity falling within the range of from about 8° to about 10°.

6. A cutter bit, and a base member and bit holder assembly therefor, for mounting said cutter bit to a driven element of a mining machine, said cutter bit comprising an elongated shank having a rearward end and a forward cutting end, said bit holder having a shank with a forward end and tapered rearwardly and inwardly from said forward ends, said bit holder having a shank receiving perforation formed therein to receive a portion at least of said cutter bit shank, means in association with said bit holder and said cutter bit to determine the depth to which said cutter bit shank is received in said bit holder shank receiving perforation, means in association with said cutter bit and said bit holder to releasably retain said cutter bit shank in said shank receiving perforation of said bit holder, said base member having an upstanding body with forward and rearward faces, said base member having a tapered cavity extending therethrough from said forward face through said rearward face, said tapers of said bit holder shank and base member cavity, corresponding and having the same angularity of up to 12°, whereby, once said bit holder shank is set in said base member cavity by axial blows to said bit holder from an appropriate tool, it will remain therein without relative rotational and axial movement between said bit holder shank and said base member cavity until said bit holder is removed from said base member by an appropriate prying tool.

7. The cutter bit and the base member and bit holder assembly therefor claimed in claim 6 wherein said cutter bit is chosen from the class consisting of a square shoulder bit and a plumb-bob bit.

8. The cutter bit and the base member bit holder assembly therefor claimed in claim 7 wherein said bit holder shank has a rearward end portion, said bit holder shank rearward end portion extending beyond said rearward face of said base member when said bit holder is set in said base member, said rearward end portion having an annular groove formed therein spaced rearwardly of said base member rear face, a split metal safety ring mounted in said groove.

9. The cutter bit and the base member and bit holder therefor claimed in claim 7 wherein said mining machine is a continuous mining machine and said tapers have an angularity of about 8°.

10. The cutter bit and the base member and bit holder therefor claimed in claim 7 wherein said mining machine is a long wall mining machine and said tapers have an angularity of about 10°.

11. The cutter bit and the base member and bit holder assembly therefor claimed in claim 6 wherein said bit holder shank has a rearward end portion, said bit holder shank rearward end portion extending beyond said rearward face of said base member when said bit holder is set in said base member, said rearward end portion having an annular groove formed therein spaced rearwardly of said base member rear face, a split metal safety ring mounted in said groove.

12. The cutter bit and the base member and bit holder therefor claimed in claim 11 wherein said tapers have an angularity falling within the range of from about 6° to about 12°.

13. The cutter bit and the base member and bit holder therefor claimed in claim 11 wherein said tapers have an angularity falling within the range of from about 8° to about 10°.

14. The cutter bit and the base member and bit holder therefor claimed in claim 6 wherein said tapers have an angularity falling within the range of from about 6° to about 12°.

15. The cutter bit and the base member and bit holder therefor claimed in claim 6 wherein said tapers have an angularity falling within the range of from about 8° to about 10°.

16. The cutter bit and the base member and bit holder therefor claimed in claim 6 wherein said mining machine is a continuous mining machine and said tapers have an angularity of about 8°.

17. The cutter bit and the base member and bit holder therefor claimed in claim 6 wherein said mining machine is a long wall mining machine and said tapers have an angularity of about 10°.

18. A cutter bit holder for use with a mining machine mounted base member, said cutter bit holder comprising a shank portion, said shank portion having a rearward end, said cutter bit holder having a bit shank-receiving perforation therein said shank portion having a longitudinal taper such that the transverse dimension of said shank portion dishes toward said shank rearward end, said taper having an angularity falling within the range of from about 6° to about 12°.

19. A base member for supporting a cutter bit holder on a driven member of a mining machine, said base member comprising an upstanding body having a forward face and a rearward face, a tapered cavity extending through said upstanding body from said forward face through said rearward face, said taper being such that the transverse dimension of said cavity diminishes from said forward face to said rearward face, said taper having an angularity falling within the range of from about 6° to about 12°.

* * * * *

UNITED STATES PATENT AND TRADEMARK OFFICE

CERTIFICATE OF CORRECTION

PATENT NO. : 5,370,448

DATED : December 6, 1994

INVENTOR(S) : Lester J. Sterwerf, Jr.

It is certified that error appears in the above-indentified patent and that said Letters Patent is hereby corrected as shown below:

Column 10, line 38, (claim 18), insert --,-- after --therein--

Column 10, line 40, (claim 18), delete "dishes" and insert --diminishes--

Signed and Sealed this

Thirty-first Day of October 1995

*Attest:*

Bruce Lehman

BRUCE LEHMAN

*Attesting Officer*

*Commissioner of Patents and Trademarks*